US005204996A

United States Patent [19]

Ehmka

[11] Patent Number: 5,204,996

[45] Date of Patent: Apr. 27, 1993

[54] TODDLER FOOT COVERING ORGANIZATION

[76] Inventor: Lori A. Ehmka, 3775 Boyd Ave., Apt 80, San Diego, Calif. 92111

[21] Appl. No.: 808,475

[22] Filed: Dec. 16, 1991

[51] Int. Cl.[5] ..... A41F 11/14

[52] U.S. Cl. ..... 2/240; 2/302; 24/336

[58] Field of Search ..... 2/240, 302, 303, 80, 2/111, 304, 338, 239, 335, 336, 339, DIG. 9, 112, 83; 24/336, 545, 562, 531; 36/2 R, 58.5

[56] References Cited

U.S. PATENT DOCUMENTS

| | | | |
|---|---|---|---|
| 962,089 | 6/1910 | Newton | 2/240 |
| 1,142,201 | 6/1915 | Peterson | 2/315 |
| 1,161,548 | 11/1915 | Taylor | 2/240 |
| 1,226,208 | 5/1917 | Handshuck | 2/240 |
| 1,437,123 | 11/1922 | Wiechmann | 2/240 |
| 1,929,015 | 10/1933 | Collins | 2/240 |
| 2,242,898 | 5/1941 | Switz | 2/111 |
| 2,433,017 | 12/1947 | Romanowski et al. | 2/111 |
| 2,599,355 | 6/1952 | Stepp | 2/111 |
| 2,638,602 | 5/1953 | Binkowitz | 2/240 |
| 3,566,411 | 3/1971 | Gordon | 2/240 |
| 3,653,074 | 4/1972 | Nobile et al. | 2/80 |

FOREIGN PATENT DOCUMENTS

| | | | |
|---|---|---|---|
| 22391 | of 1911 | United Kingdom | 2/240 |
| 9741 | of 1914 | United Kingdom | 2/240 |
| 327027 | 3/1930 | United Kingdom | 2/240 |

*Primary Examiner*—Clifford D. Crowder
*Assistant Examiner*—Amy Brooke Vanatta
*Attorney, Agent, or Firm*—Leon Gilden

[57] ABSTRACT

A tubular "L" shaped member includes a tubular foot and leg cover interconnected by a single cavity, wherein the foot covering includes a planar bottom surface formed with spaced parallel ribs coextensive therewith. The upper terminal end of the leg cover portion includes a reinforcement strip to include a plurality of spaced bores directed therethrough, wherein each bore is arranged for securement to a clip member. Each clip member includes a plurality of clamps to grasp the leg cover portion and a clothing garment positioned thereabove.

2 Claims, 4 Drawing Sheets

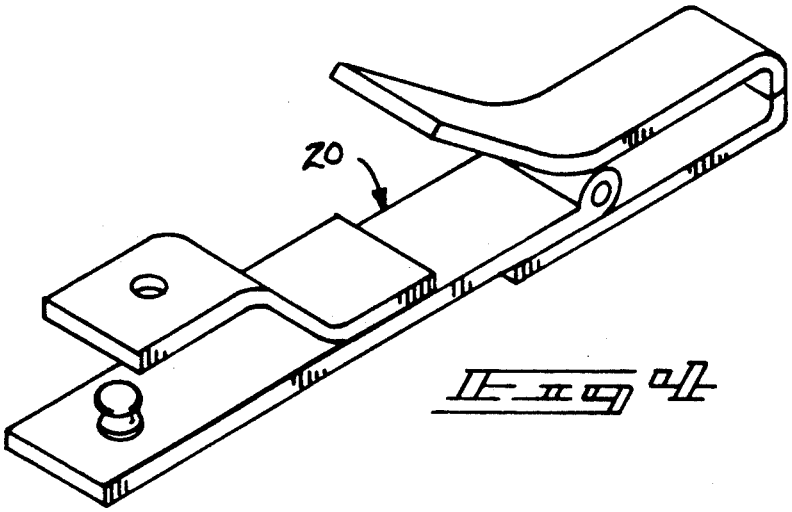
Fig 4
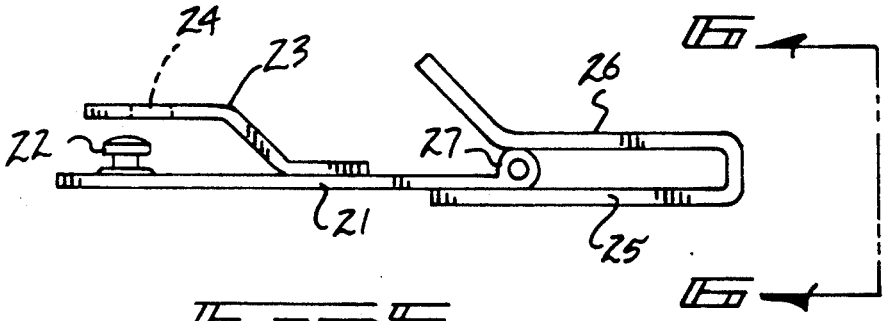
Fig 5
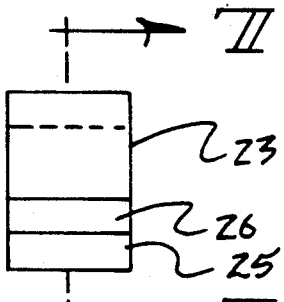
Fig 6
Fig 7
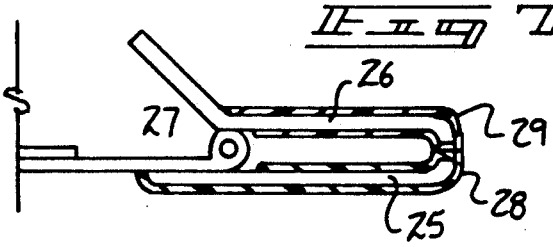

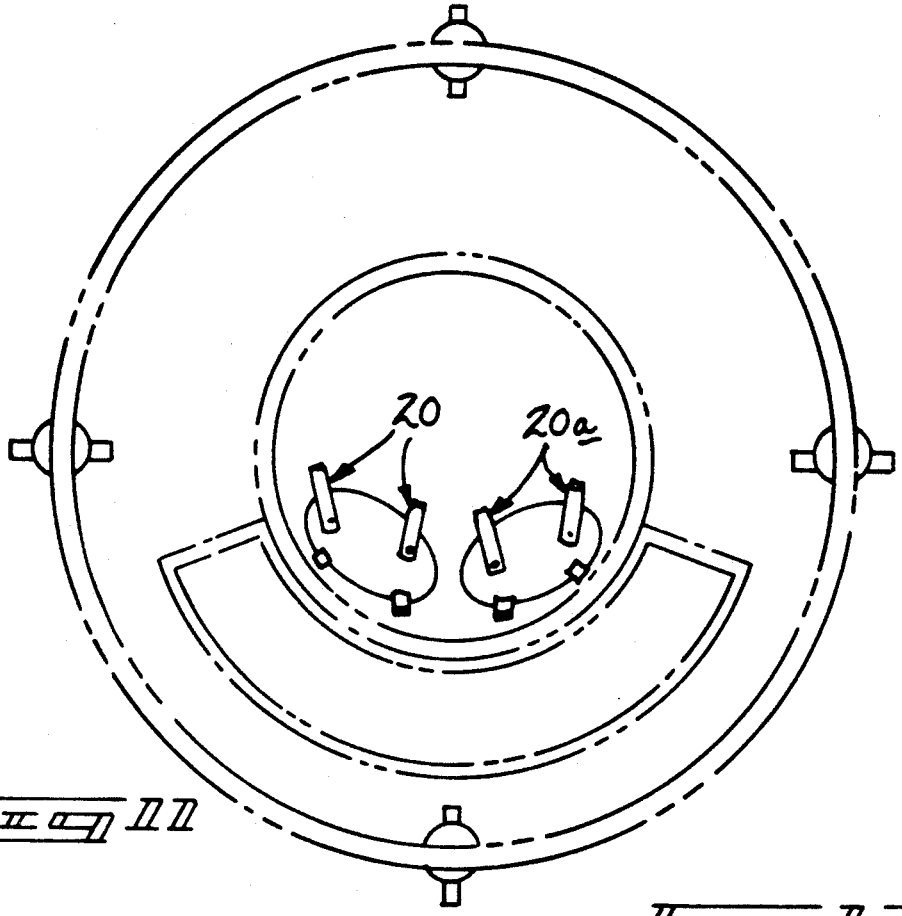
Fig 11
Fig 12
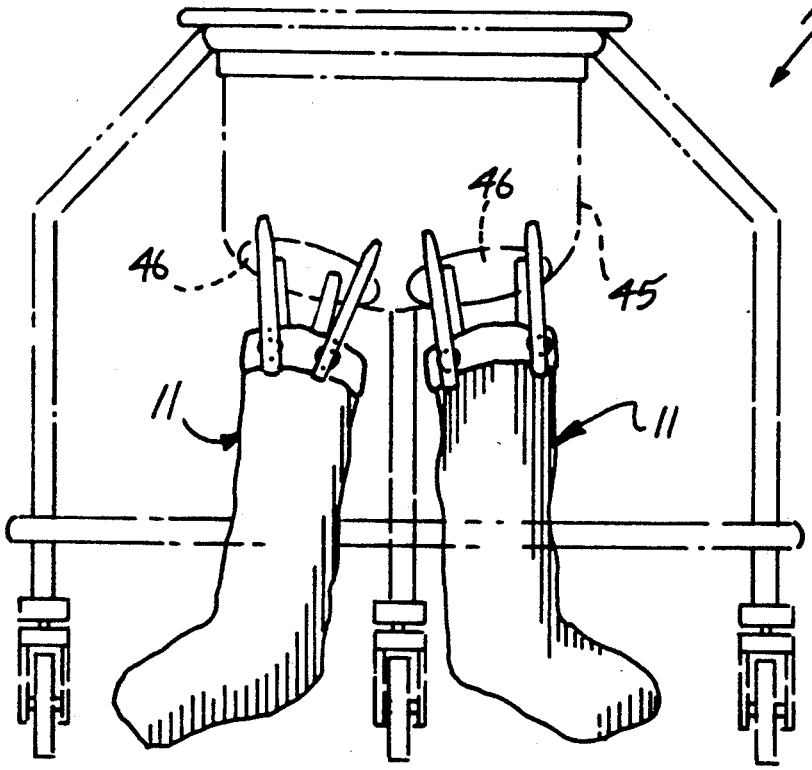

TODDLER FOOT COVERING ORGANIZATION

BACKGROUND OF THE INVENTION

1. Field of the Invention

The field of invention relates to foot covering apparatus, and more particularly pertains to a new and improved toddler foot covering organization wherein the same is arranged to effect covering of a young child permitting ease of movability during initial stages of walking.

2. Description of the Prior Art

Foot coverings of various types are available in the prior art for application to a variety of specialized situations. Such is exemplified in U.S. Pat. No. 4,622,697 to Tajima wherein ski pants covering material is formed with a single web securable to itself to define a tubular covering garment.

U.S. Pat. No. 4,964,176 to Previdi sets forth a leg rain protector, wherein the device includes a plurality of flexible plastic sheets, each sheet including bands of adhesive to permit securement of the sheets together to form a tubular covering member.

U.S. Pat. No. 3,605,122 to Myers sets forth an adjustable plastic stocking formed with a tubular upper securable to a lower member to cover a heel and leg portion of an individual.

As such, it may be appreciated that there continues to be a need for a new and improved toddler foot covering organization as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of foot covering apparatus now present in the prior art, the present invention provides a toddler foot covering organization wherein the same is arranged to define a foot covering socket complementary with a leg covering cavity to afford protection to a toddler during initial training stages of walking. As such, the general purpose of the present invention, which will be described subsequently in greater detail, is to provide a new and improved toddler foot covering organization which has all the advantages of the prior art foot covering apparatus and none of the disadvantages.

To attain this, the present invention provides a tubular "L" shaped member including a tubular foot and leg cover interconnected by a single cavity, wherein the foot covering includes a planar bottom surface formed with spaced parallel ribs coextensive therewith. The upper terminal end of the leg cover portion includes a reinforcement strip to include a plurality of spaced bores directed therethrough, wherein each bore is arranged for securement to a clip member. Each clip member includes a plurality of clamps to grasp the leg cover portion and a clothing garment positioned thereabove.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toddler foot covering organization which has all the advantages of the prior art foot covering apparatus and none of the disadvantages.

It is another object of the present invention to provide a new and improved toddler foot covering organization which may be easily and efficiently manufactured and marketed.

It is a further object of the present invention to provide a new and improved toddler foot covering organization which is of a durable and reliable construction.

An even further object of the present invention is to provide a new and improved toddler foot covering organization which is susceptible of a low cost of manufacture with regard to both materials and labor, and which accordingly is then susceptible of low prices of sale to the consuming public, thereby making such toddler foot covering organizations economically available to the buying public.

Still yet another object of the present invention is to provide a new and improved toddler foot covering organization which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an isometric illustration of a clip member utilized by the invention.

FIG. 5 is an orthographic side view of the clip member.

FIG. 6 is an orthographic view, taken along the lines 6—6 of FIG. 5 in the direction indicated by the arrows.

FIG. 7 is an orthographic view, taken along the lines 7—7 of FIG. 6 in the direction indicated by the arrows.

FIG. 11 is an orthographic top view of the apparatus.

FIG. 12 is an orthographic frontal view, taken in elevation, of the apparatus in use.

DESCRIPTION OF THE PREFERRED EMBODIMENT

Figure 1:
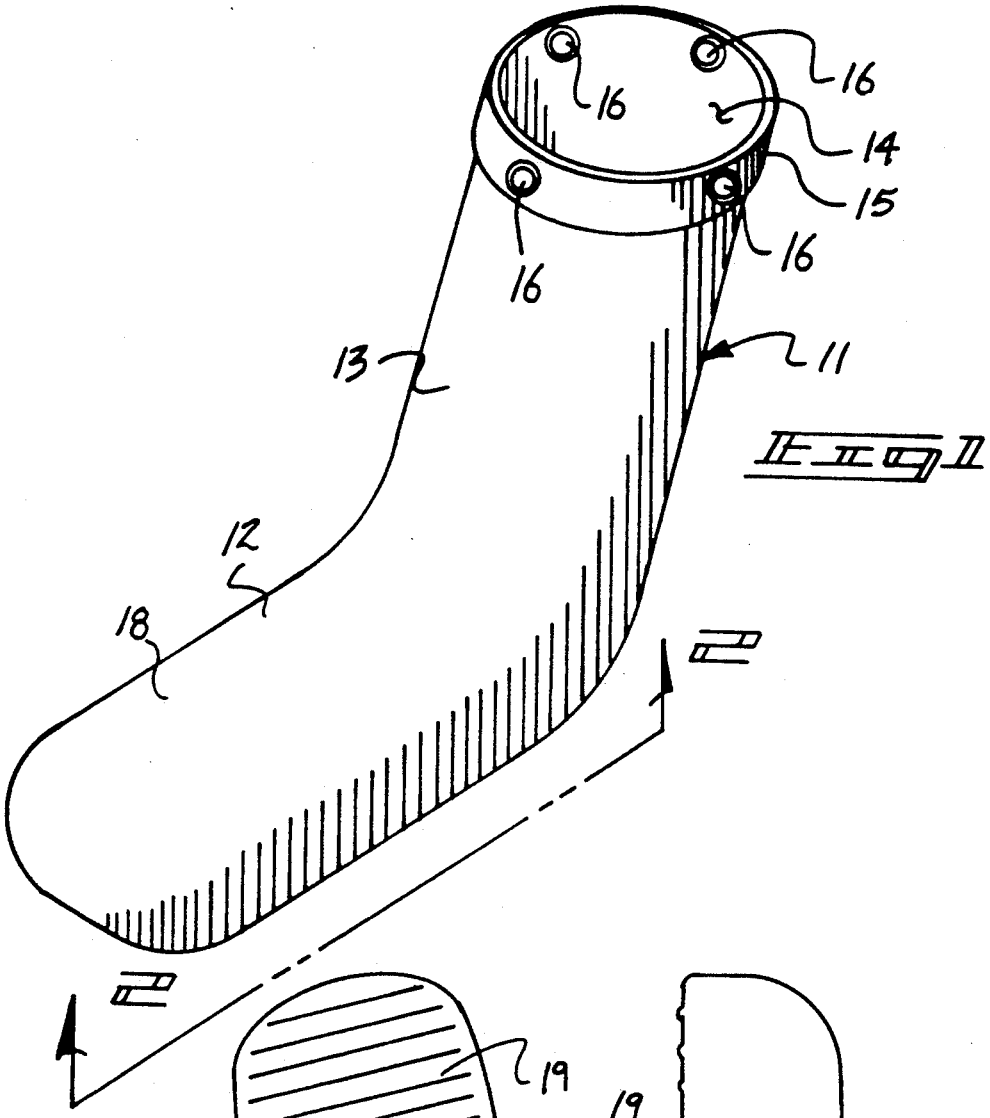
FIG. 1 is an isometric illustration of the "L" shaped shoe member utilized by the invention.

With reference now to the drawings, and in particular to FIGS. 1 to 12 thereof, a new and improved toddler foot covering organization embodying the principles and concepts of the present invention and generally designated by the reference numeral 10 will be described.

Figure 2:
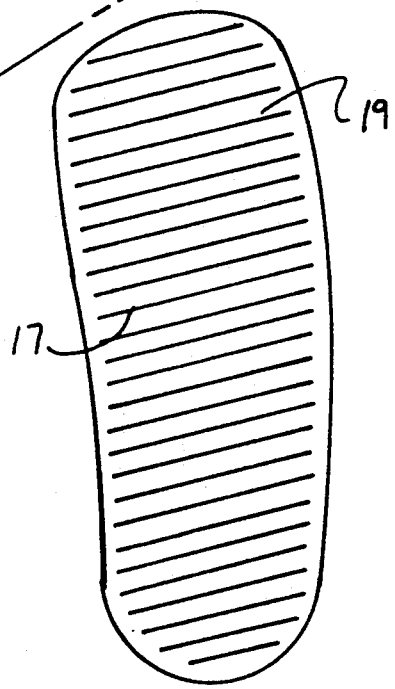
FIG. 2 is an orthographic view, taken along the lines 2—2 of FIG. 1 in the direction indicated by the arrows.
Figure 3:
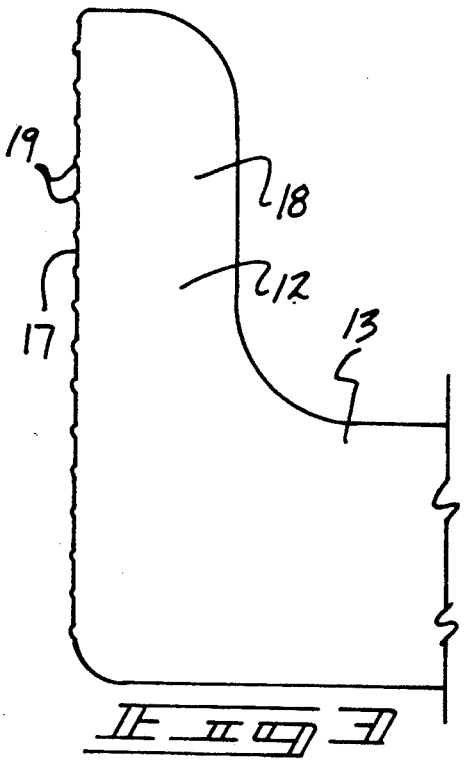
FIG. 3 is an orthographic partial side view of the shoe member, as illustrated in FIG. 1.
Figure 8B:
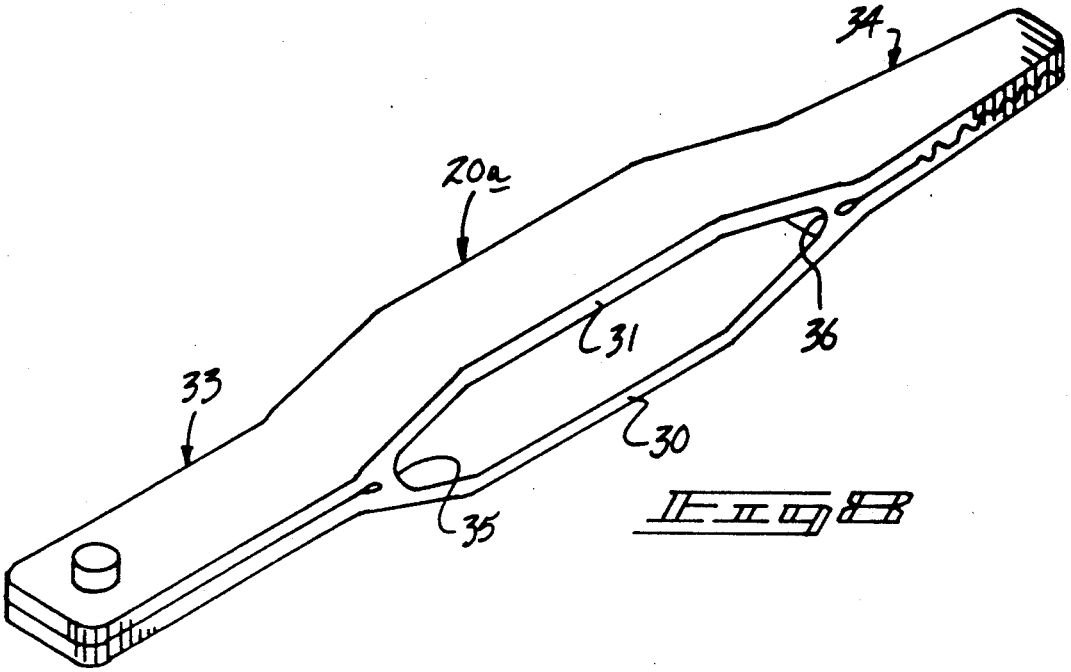
FIG. 8 is an isometric illustration of a modified clip member.

More specifically, the toddler foot covering organization 10 of the instant invention essentially comprises an "L" shaped shoe member 11, such as illustrated in the FIGS. 1-3, cooperative with a mounting clip 20 or 20*a*, of a type as illustrated in the FIGS. 4 and 8 respectively, to secure the shoe member 11 to an associated clothing garment 45, such as illustrated in the FIG. 12.

The "L" shaped shoe member 11 is formed of a flexible fibrous material, including a foot cover portion 12 to define a foot receiving socket that is in communication with a tubular leg cavity of an associated leg cover portion 13. An entrance opening 14 of the leg cover portion 13 is formed with a reinforcement strip 15 circumferentially thereabout to include equally spaced strip openings 16. The foot cover portion 12 further includes a foot cover planar bottom surface 17 formed underlying a foot cover upper surface 18. Spaced parallel ribs 19 formed of a resilient polymeric material are arranged coextensively throughout the bottom surface 17.

The mounting clip structure of the organization illustrates a mounting clip 20, such as illustrated in FIG. 4, including a base plate 21 formed with a boss projection 22 extending orthogonally and upwardly relative to the base plate 21 that is cooperative with a clamp plate 23 that is formed of a deflectable shape retentent material. The clamp plate 23 includes a clamp plate bore 24 spaced above and offset relative to the boss projection 22, whereupon deflection of the clamp plate 23, the bore 24 is arranged to receive the boss projection 22 in a locking orientation as the boss projection includes an upper head portion extending laterally and radially beyond the body of the boss projection, and wherein the clamp plate 23 is thereafter captured between the head portion and the body of the boss projection 22. A lower fixed clamp jaw 25 longitudinally aligned with the base plate 21 extending forwardly of the base plate is cooperative with an upper pivotal jaw 26 pivotal about a spring hinge 27 to bias the upper pivotal jaw in cooperation with the lower fixed jaw 25. As required, a polymeric covering 28 and 29 respectively is mounted about the lower and upper jaws respectively to afford protection to a clothing garment 45, such as in a type as illustrated in the FIG. 12.

Figure 9:
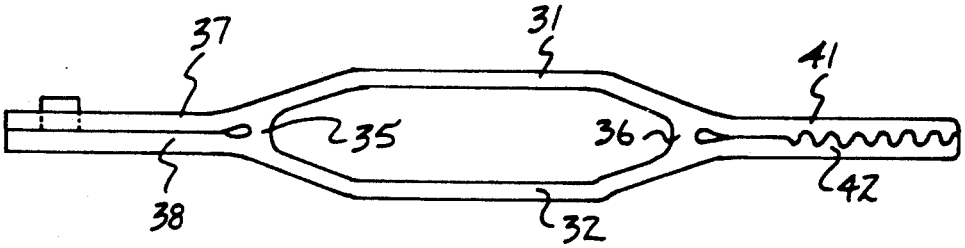
FIG. 9 is an orthographic side view of the clip member in a first position.
Figure 10:
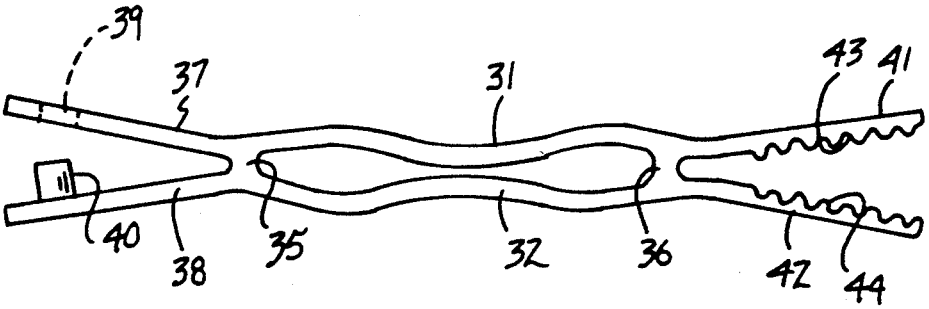
FIG. 10 is an isometric illustration of the clip member in a second position.

The FIGS. 8-10 illustrate a modified clip structure 20*a* that includes a tubular central portion 30 defined by a tubular top wall 31 spaced from and parallel a tubular bottom wall 32 in a first position that are joined together at each end thereof by a respective first clamp web 35 and a second clamp web 36. The top and bottom walls 31 and 32 are deflectable towards one another to a second position, in a manner as illustrated in FIG. 10. The modified clip structure 20*a* is accordingly formed of a deformable memory shape retentent material to effect "spring back" to the first position, as illustrated in FIG. 9, from the second position, as illustrated in FIG. 10. A first clamp 33 is mounted forwardly of the first connecting web 35, wherein a second clamp 34 longitudinally aligned with the first clamp extends forwardly of the second clamp web 36. The first clamp 33 includes a first clamp top jaw 37 cooperative with a first clamp bottom jaw 38 that are biased together in contiguous orientation relative to one another in the first position, wherein the first clamp top plate jaw 37 includes a first clamp top plate jaw bore 39 to receive a first clamp bottom jaw boss 40 fixedly and orthogonally mounted to a top surface of the first clamp bottom jaw 38 to receive one of said strip openings 16 in a clamped position between the first top and bottom jaws 37 and 38. The second jaw 34 is formed with a second clamp top jaw 41 biased towards a second clamp bottom jaw 42 in a contiguous relationship formed with interdigited jaw teeth, wherein the second clamp top jaw 41 includes second clamp top jaw teeth 43 interfitting with second clamp bottom jaw teeth 44. In this manner, the jaw teeth 43 and 44 are arranged to grasp a clothing garment 45, such as a pants member, therebetween in surrounding relationship relative to spaced leg openings 46.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A toddler foot covering organization, comprising in combination, an "L" shaped shoe member formed of a flexible fibrous material, wherein the "L" shaped shoe member includes a foot cover portion defining a foot receiving socket cooperative with a tubular leg cavity defined by a leg cover portion, wherein the leg cover portion includes an entrance opening directed into the tubular leg cavity and the foot receiving socket, and the entrance opening is formed at an upper terminal end of the leg cover portion, and wherein the upper terminal end of the leg cover portion includes a reinforcement strip, the reinforcement strip includes a plurality of equally spaced strip openings directed therethrough, and a clip member mounted to each strip opening, and the clip member further adapted for releasable mounting to a clothing garment positioned above the reinforcement strip, and the foot cover portion includes a planar bottom surface, the planar bottom surface orthogonally oriented relative to the leg cover portion, and the planar bottom surface including a matrix of spaced parallel ribs directed coextensively along the planar bottom surface, and each mounting clip includes a tubular central portion deflectable from a first position to a second position, wherein the clip member is formed of a memory shape retentent material and the tubular central portion includes a top wall spaced from and parallel a bottom wall in the first position, and a first clamp web spaced from a second clamp web integral with and on opposed distal ends of the tubular central portion, and each mounting clip further including a first clamp projecting longitudinally beyond the tubular central portion and the first clamp joined to the first clamp web, and a second clamp longitudinally extending beyond the tubular central portion and the second clamp joined to the second clamp web, wherein the first clamp and the second clamp are longitudinally aligned relative to one another and the first clamp includes a first clamp top jaw in contiguous communication with a first clamp bottom jaw in the first position, wherein the first clamp top jaw includes a first clamp top jaw bore and the first clamp bottom jaw includes a first clamp bottom jaw boss slidably receivable within the bore in the first position and separated from the bore in the second position to receive one of said strip openings about the boss and to clamp the reinforcement strip between the first clamp top jaw and the first clamp bottom jaw, and the second clamp including a second clamp top jaw and a second clamp bottom jaw, and wherein the second clamp top jaw includes second clamp top jaw teeth, and the second clamp bottom jaw includes second clamp bottom jaw teeth, wherein the second clamp top jaw teeth and the second clamp bottom jaw teeth are arranged to define an interdigited clamp jaw matrix in the first position for securement to the clothing garment.

2. A toddler foot covering organization as set forth in claim 1 wherein the clothing garment includes a plurality of spaced leg openings, and each mounting clip is secured to the clothing garment about one of said leg openings.

* * * * *